United States Patent [19]

Rasovich

[11] Patent Number: 4,858,445

[45] Date of Patent: Aug. 22, 1989

[54] COMBINATION CRYOGENIC AND MECHANICAL FREEZING SYSTEM

[76] Inventor: Ivan Rasovich, 8950 Glenoaks Blvd., Sun Valley, Calif. 91352

[21] Appl. No.: 248,965

[22] Filed: Sep. 26, 1988

[51] Int. Cl.[4] ..... F25D 17/02

[52] U.S. Cl. ..... 62/374; 62/332; 62/380

[58] Field of Search ..... 62/63, 374, 380, 332

[56] References Cited

U.S. PATENT DOCUMENTS

| | | | |
|---|---|---|---|
| 3,413,818 | 12/1968 | Pelmulder | 62/380 |
| 3,427,820 | 2/1969 | Hart | 62/380 |
| 3,507,128 | 4/1970 | Murphy et al. | 62/374 |
| 3,531,946 | 10/1970 | Hart | 62/332 |
| 3,832,864 | 9/1974 | Rasovich | 62/374 |
| 4,403,479 | 9/1983 | Rasovich | 62/380 |

OTHER PUBLICATIONS

Koach Freezing Systems brochure Food Engineering, Jun. 1988, p. 108.

*Primary Examiner*—Ronald C. Capossela
*Attorney, Agent, or Firm*—Harris, Kern, Wallen & Tinsley

[57] ABSTRACT

A freezing system combining a cryogenic freezer and a mechanical refrigeration freezer, with the cryogenic vapor from the cryogenic freezer being used to lower the temperature of the air in the refrigeration freezer. The cryogenic vapor from the cryogenic freezer is passed through a heat exchanger in the refrigeration freezer with the heat exchanger positioned downstream of the evaporator coil of the refrigeration freezer and upstream of the product conveyor belt.

12 Claims, 6 Drawing Sheets

COMBINATION CRYOGENIC AND MECHANICAL FREEZING SYSTEM

BACKGROUND OF THE INVENTION

This invention relates to a new and improved freezing system suitable for the freezing of food products, and in particular, to a new and improved freezing system combining a cryogenic freezer and a mechanical refrigeration freezer.

Mechanical refrigeration freezers have been known and used for many many years. Cryogenic freezers have been known and used for more than twenty five years and two such freezers are shown in U.S. Pat. Nos. 3,832,864 and 4,403,479.

Cryogenic freezing systems provide cooling by vaporizing liquefied gases, such as carbon dioxide ($C0_2$), nitrogen ($LN_2$) and others. This process is capable of producing low temperatures to −320° F. Typically the product to be frozen is immersed in the cryogenic liquid, or the cryogenic liquid is sprayed onto the product. Cryogenic systems are also called "Expendable Refrigerant Systems " since the recovery of the cryogenic fluid is not usually attempted.

Mechanical refrigeration systems, usually called conventional, provide cooling by evaporation, compressing and condensing various refrigerants in a closed loop system. Mechanical refrigeration systems usually produce temperatures to −40° F. Two-stage and cascade systems are capable of producing low temperatures to about −120° F.

Positive features of cryogenic systems include the following. Very fast cooling/freezing, resulting in better quality and minimal dehydration (weight loss) of the product, usually less than 1%. Substantially smaller and less costly equipment for the given freezing capacity. The product is enveloped in an oxygen-free atmosphere which eliminates so called "freezer burns " and usually results in better product quality. Cryogenic systems are usually more suitable for so called IQF (individually quick frozen) products. The immersion of products in liquid nitrogen produces boiling of the liquid and IQF products are easily obtained.

A negative aspect of tne cryogenic system is the usually higher cost of freezing, especially for low cost products such as fruits and vegetables. Freezing fresh meats usually requires 1 pound of $LN_2$ or 1½ pounds of $CO_2$ per pound of meat. Fruits and vegetables require even more; 1½ to 2 pounds of $LN_2$ or $CO_2$ per pound. The cost of $CO_2$ or $LN_2$ is usually 4 to 8 per pound of frozen product.

The most important feature of mechanical refrigeration is the lower cost of freezing after the initial cost of the equipment is amortized. The cost of freezing is usually 3 to 4 per pound of product, depending on the cost of electricity in a given area.

Major weaknesses of mechanical refrigeration freezers include the following. They require a substantial amount of floor space. They are very costly and require a lot of electrical power. The slower freezing results in a lower quality product. Cleaning and maintenance are costly and require a considerable amount of down time. The cooling coils need to be defrosted every three to four hours, and the necessary halt in the freezing operation interrupts continuous operation of other production lines. Weight loss (dehydration) of the product is 2 to 8% and, ir accounted in the cost of freezing, in some cases may be more expensive than cryogenic freezing.

Most mechanical systems cannot produce IQF quality of product, rather the pieces freeze together and to the conveyor belt.

Freezing food and other products has become the most popular method of preservation, particularly since the discovery of ill-effects of various chemical preservatives. The food industry, in particular, has a need for freezing systems that can produde the best possible product quality and at the lowest possible initial and operating costs. Other desirable features for a better freezing system are compactness, operating flexibility and capability to produce IQF quality products.

SUMMARY OF THE INVENTION

The freezing system of the present invention is a combination of cryogenic and mechanical systems, combining the best features of both, eliminating or reducing the weaknesses, and improving operation of each individual system.

The operation of the combination freezing system of the invention can be briefly described as follows. The product travels on a conveyor belt and is first introduced into the cryogenic section of the freezing system. In this section, depending on the design, the product is quickly crust frozen by: passing through a liquid nitrogen bath, as in the case of liquid nitrogen immersion-type freezing or travelling through a liquid nitrogen spray and cold vapor blast, as in the case of liquid nitrogen spray-type freezing; or travelling through a high velocity blast of cold $CO_2$ vapor, as in the case of $CO_2$ spray-type freezing; or being en-eloped with dry ice snow (frozen $CO_2$), as in the case of a flighted $CO_2$ type system.

Exposing the product to a very cold cryogenic liquid, vapor or solid results in quick surface freezing, or so-called crust freezing, of the product. The initial quick surface freezing of the product is highly desirable in a freezing system. A frozen crust seals the surface of the product which stops or substantially reduces product dehydration and associated weight loss of the product. Heat transfer through the frozen crust is three to four times faster for most food products than heat transfer through fresh product. The amount of cryogenic fluid required to form a frozen crust is only 10 to 30 % of the amount required to completely freeze the product, resulting in a reduction of cost. Quick freezing ruptures very few product cells, resulting in a minimal loss of quality. Individually crust frozen pieces will not stick together or to the conveyor belt, thus IQF quality is easily obtained.

After crust freezing in the cryogenic section, the product is passed to the mechanical refrigeration section of the system where a blast of cold air around and over the product completes the freezing process.

Both the cryogenic and mechanical sections are designed to operate efficiently as a combined system or individually. The cryogenic section generates a substantial amount of very low temperature cryogenic vapor. The design of the freezing system is such that it fully utilizes the cryogenic vapor for improved operation of the invention of both freezer sections. At the exit end of the cryogenic section in the preferred configuration, the cold vapor is restrained and directed to flow into a vapor collector box. It is then introduced into the mechanical section where it passes through a vapor-to-air heat exchanger, an exhaust duct, a capacity control system, and a exhaust fan to the outside of the building.

The cryogenic vapor passing through the mechanical freezer section reduces the temperature of air and product. The cryogenic vapor is discharged at 0° to −40° F., resulting in about 95% utilization of the cooling capacity of cryogenic fluid. The existing cryogenic freezers operate with an efficiency of less than 80%.

The mechanical freezer section is designed with forced air circulation. Fans may pull or push the ir through the cooling coil, depending on the design. Typically, in the freezers operating at nominal −30° F. the air leaving the product is at about 0° F. Passing through the coil, air temperature is reduced to −30° F. The vapor-to-air heat exchanger is placed downstream of the coil. Passing through the heat exchanger, the air temperature is reduced by additional 10° to 15° F. before it is again introduced over the product to close the circuit.

A major benefit of the invention is the considerably improved operation of the mechanical section. Conventiona mechanical freezers that deliver −40° F. air over the product must operate the evaporator coils at about −50° F. In the combined system of the invention the −40° F. air, or lower, is achieved with a coil temperature of about −40° F. The capacity of the refrigeration system operating at −40° F. instead of −50° F. is about 25% higher.

Inside the mechanical freezer, the cryogenic vapor preferably flows through a system of closed ducts, and thus does not mix with air. This makes it possible for people to walk in the mechanical section without having to use special breathing equipment.

The product travels on a conveyor through the mechanical freezer. At the entrance, the crust frozen product is exposed to very cold air (−40° to −50° F.) and the thickness of the frozen crust is quickly increased. This prevents dehydration and accompanying product weight loss. As the product continues to travel through the freezer, total freezing is quickly accomplished. The heat transfer through the frozen crust is three to four times faster (depending on the product) than it is through an unfrozen surface. This faster rate of freezing improves product quality and considerably reduces the required freezer length and dwell time.

A major additional benefit of the vapor-to-air heat exchanger is the accumulation of ice on it, as opposed to ice on the cooling coil. Water vapor pressure noticeably drops as the air temperature is reduced. In conventional mechanical freezers, the coldest spot is the cooling coil which attracts water vapor and freezes it onto the coil. This ice reduces the air passages and acts as an insulator between the refrigerant inside the coil and the air flowing over the coil, causing the air temperature to increase and the air flow and the temperature of the refrigerant to drop. All these combined effects result in a substantial loss of cooling capacity and a necessity to shut down operation and defrost the cooling coils usually every three to four hours. In addition to the lost production time due to the defrost periods, the mechanical refrigeration works at reduced efficiency except for a short period immediately after the defrost cycle.

The vapor-to-air heat exchanger is substantially cooler than the cooling coil, thus the ice accumulates on the heat exchanger. The freezing system of the invention includes a full-time operating ice removing system for the heat exchanger. This design makes it possible for the cooling coils and heat exchanger to be free of ice and the refrigeration system to operate all the time at peak performance without the need for defrost shut downs. The resulting cooling capacity increase is a minimum 25% and it can be as much as 75%.

Also the freezing system of the invention (for a given capacity) is much smaller than a conventional mechanical freezer as a result of much faster heat transfer. The reduced floor space and maintenance cost are additional features of the system. Cryogenic cooling can be adjusted but usually represents about 20% of the total cooling required in product freezing. The size of a mechanical refrigeration unit can be reduced by that amount and corresponding power savings realized. All electrical motors for driving the fans and conveyors are mounted outside of the insulated enclosure for additional power savings and refrigeration size reduction.

The combination freezing system offers a wide range of capacities and application flexibility. When the production rate required and product type permits, the cryogenic section does not have to be used and can serve as a shuttle conveyor only. On the other hand, if there are additional capacities required from time to time, they can be met by increasing the product's exposure to the cryogenic fluid. Also the interior of the freezing system is designed to operate at cryogenic temperatures, which includes specially designed self-aliging bearings that operate without lubrication.

Various designs of mechanical freezers can be used, including the single conveyor type with air blast through the conveyor belt which lifts the product off the belt and creates fluidization of the product, and the multi-deck tunnel type with several conveyor belts placed one above the other and air flow at the top and across the product. Spiral and serpentine type mechanical freezers can be also used as the mechanical section of the combined system.

The cryogenic freezer in the preferred embodiment illustrated, is a liquid nitrogen immersion freezer with a opening in the top, and the product is introduced directly into the liquid nitrogen bath. The heat of the product causes the nitrogen to boil, creating a stirring action which separates the individual pieces and quickly forms a frozen crust on the surface. Individually crust frozen products are passed to the mechanical freezer for completion of the freezing process. Once crust frozen, the products do not stick together or to the conveyor belt in the cryogenic and mechanical sections of the system.

For some products such as cooked pizza topping (with initial temperature of about 140° F.), liquid nitrogen immersion is only required to bring the product temperature below the freezing point of fat, which is about 80° F. Under these conditions, individual pieces may freeze together in the mechanical part of the freezer. To prevent this from happening, the conveyor belt is designed as a flighted type, consisting of several short belts with a drop between them. Dropping the product from flight to flight prevents individual pieces from freezing together until they are sufficiently frozen. The flighted design also helps to equally expose all pieces to the blast of the refrigerated air. The following conveyor tiers, if necessary, have a function to complete freezing and bring the product temperature to the desired point.

If using $CO_2$ is more desirable for a particular application, the cryogenic freezer is designed as a flighted tunnel. A system of snow horns (a device that converts liquid $CO_2$ into dry ice snow) is placed to spray dry ice snow on the product travelling on the conveyor belt flights. The speed of the conveyor flights is arranged to progressively slow down with the inlet flight turning at the highest speed. The conveyor flights and snow horns form a system that mixes a sufficient amount of dry ice (necessary for crust freezing) with the product. Crust freezing the product is a result of direct contact between dry ice at −110° F. and much warmer product. The heat of the product sublimates the dry ice, thus, at the end of the cryogenic portion, practically all the dry ice is turned into cold vapor. This vapor, together with the vapor released from the snow horns, is passed to the mechanical freezer and distributed as previously dsscribed. In this type of freezer, the heat transfer is mostly done by conduction. High freezing capacity is a result of heavy conveyor loading due to the progressive speed reduction of the conveyor flights. High efficiency is accomplished by full utilization of the cooling capacity of liquid $CO_2$ converted to vapor and dry ice.

The combination freezing system of the invention utilizes the best features of conventional cryogenic and mechanical refrigeration freezing. The whole system is designed to operate in the cryogenic temperature range. The cooling capability of the cryogenic liquids is fully utilized in the cryogenic section. The cooling capability of the cryogenic vapor which, in the case of nitrogen is about 50% of the total, is utilized in the mechanical section, thus accomplishing the most efficient use of the cryogenic fluids. The utilization of cryogenic vapor in the mechanical section can greatly improve the performance of the mechanical refrigeration, resulting in nearly 50% reduction of size and power consumption.

The positioning of the vapor-to-air heat exchanger is an important part of this invention. The heat exchanger is placed in the airstream after the mechanical refrigeration cooling coil. This means the air temperature (after being cooled by the coil) is further reduced by as much as 20° or 30° F. by passing through the heat exchanger. The air temperature reduction is greatest near the entrance of the mechanical section. This arrangement offers several advantages. Cooler air freezes the product faster and the faster the freezing, the better product quality. Heat transfer is three to four times faster through the frozen crust than through the non-frozen product surface. Colder air at the entrance of the mechanical section results in quick increase of thickness of the frozen crust, thus the larger portion of the mechanical section operates at the more efficient (faster) heat transfer rate. The usual air temperature in the mechanical blast freezers is about −30° F. The cryogenic vapor temperature entering the vapor-to-air heat exchanger is about −80° F. for $CO_2$ and −200° F. for liquid nitrogen. With such large temperature differential, it is relatively easy to cool the air to −40° F. or lower, before it is passed over the product.

It has been proposed that a cryogenic freezer be operated in tandem with a mechanical refrigeration freezer, with the product at the outlet of the cryogenic freezer being carried by a separate conveyor belt to the inlet of the mechanical freezer, and with the exhaust vapor of the cryogenic freezer being conducted to the mechanical freezer housing by a duct between the two units. However, so far as known to applicant, no such freezing system has been constructed and no proposal made for the cryogenic vapor flow path or the air flow path in the mechanical refrigerator.

DESCRIPTION OF THE PREFERRED EMBODIMENTS

Figure 1:
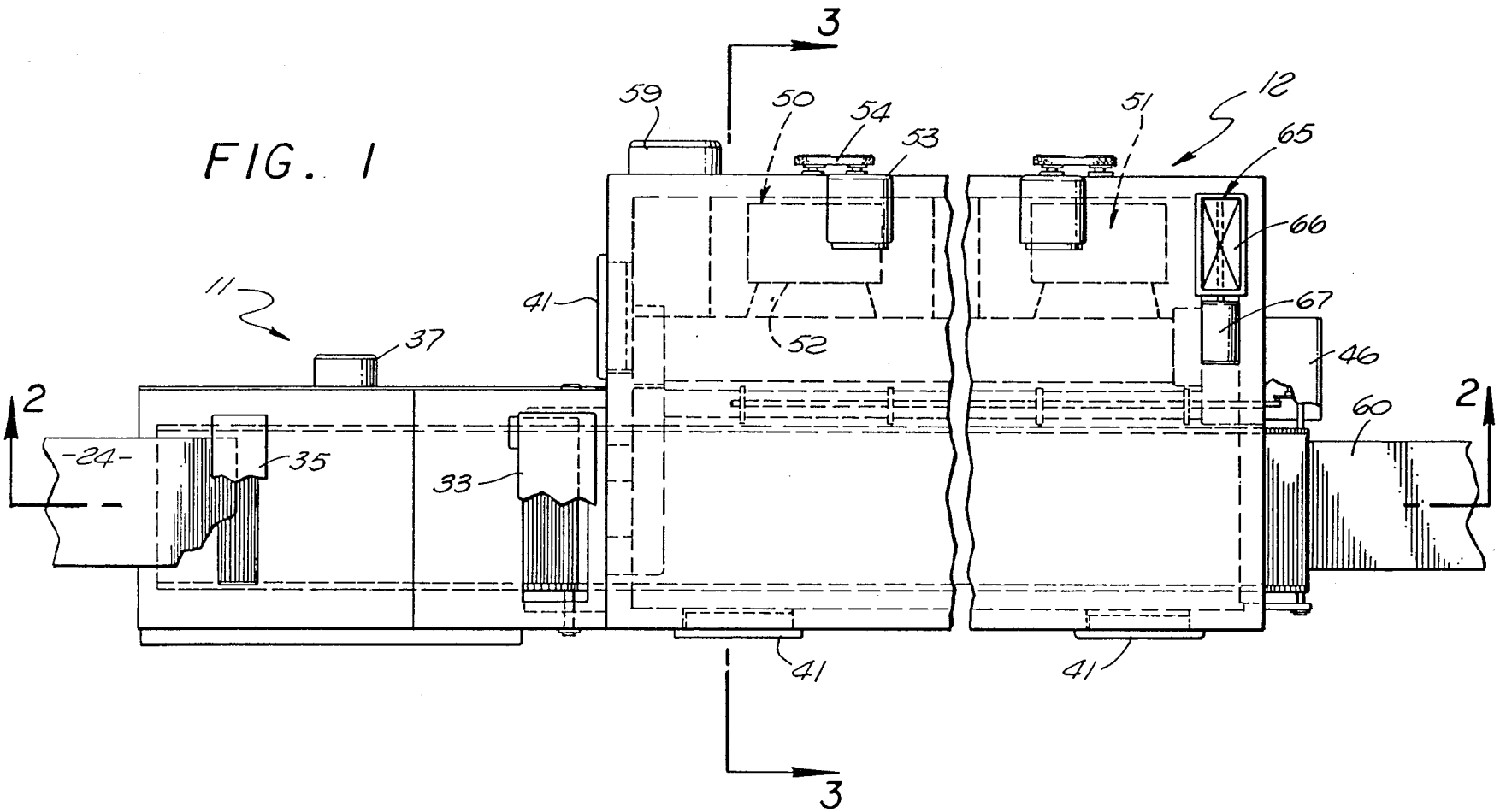
FIG. 1 is a top view, partly in section, of a freezing system incorporating the presently preferred embodiment of the invention.
Figure 2:
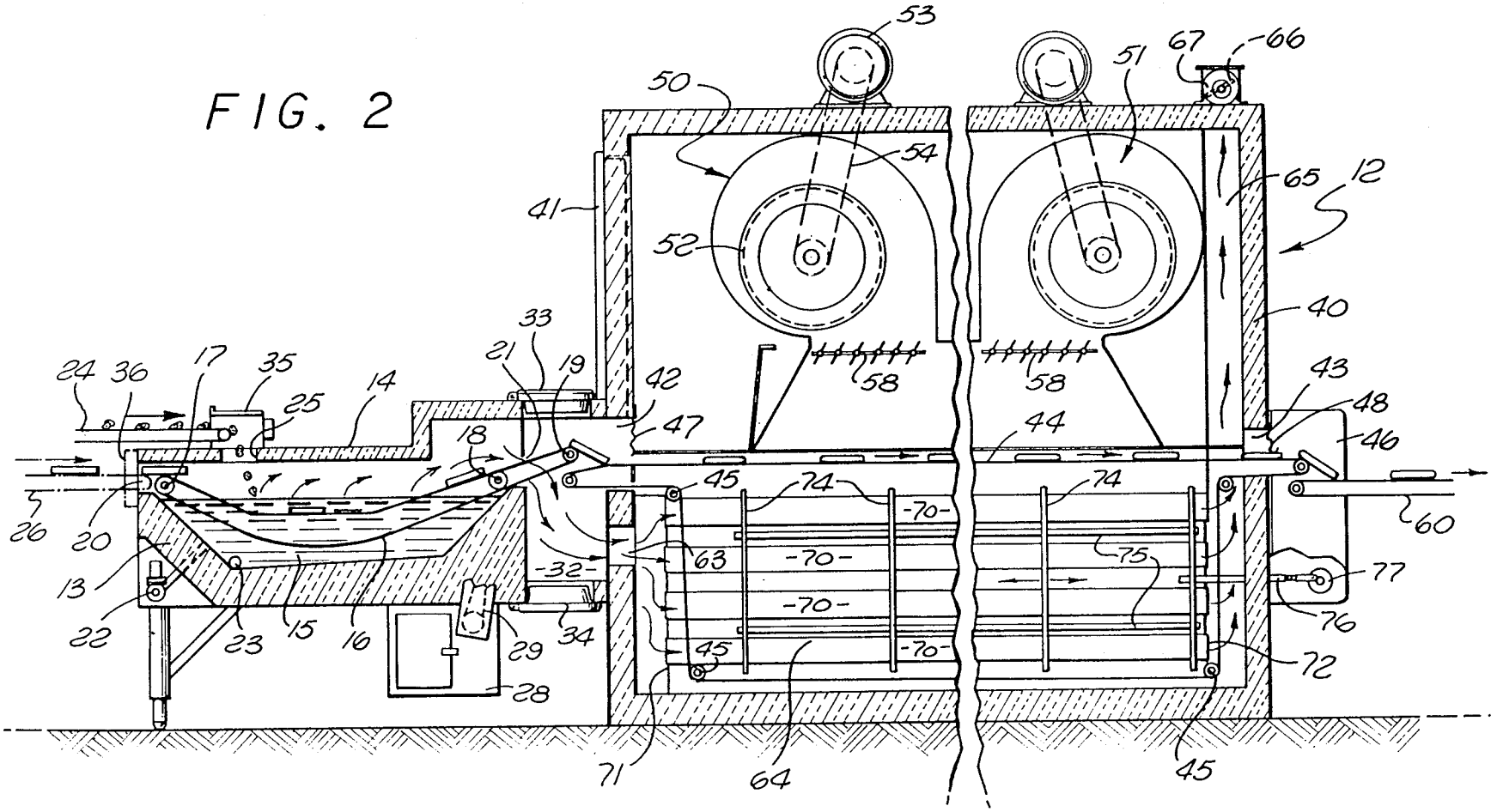
FIG. 2 is a side view taken in section along the line 2—2 of FIG. 1.
Figure 3:
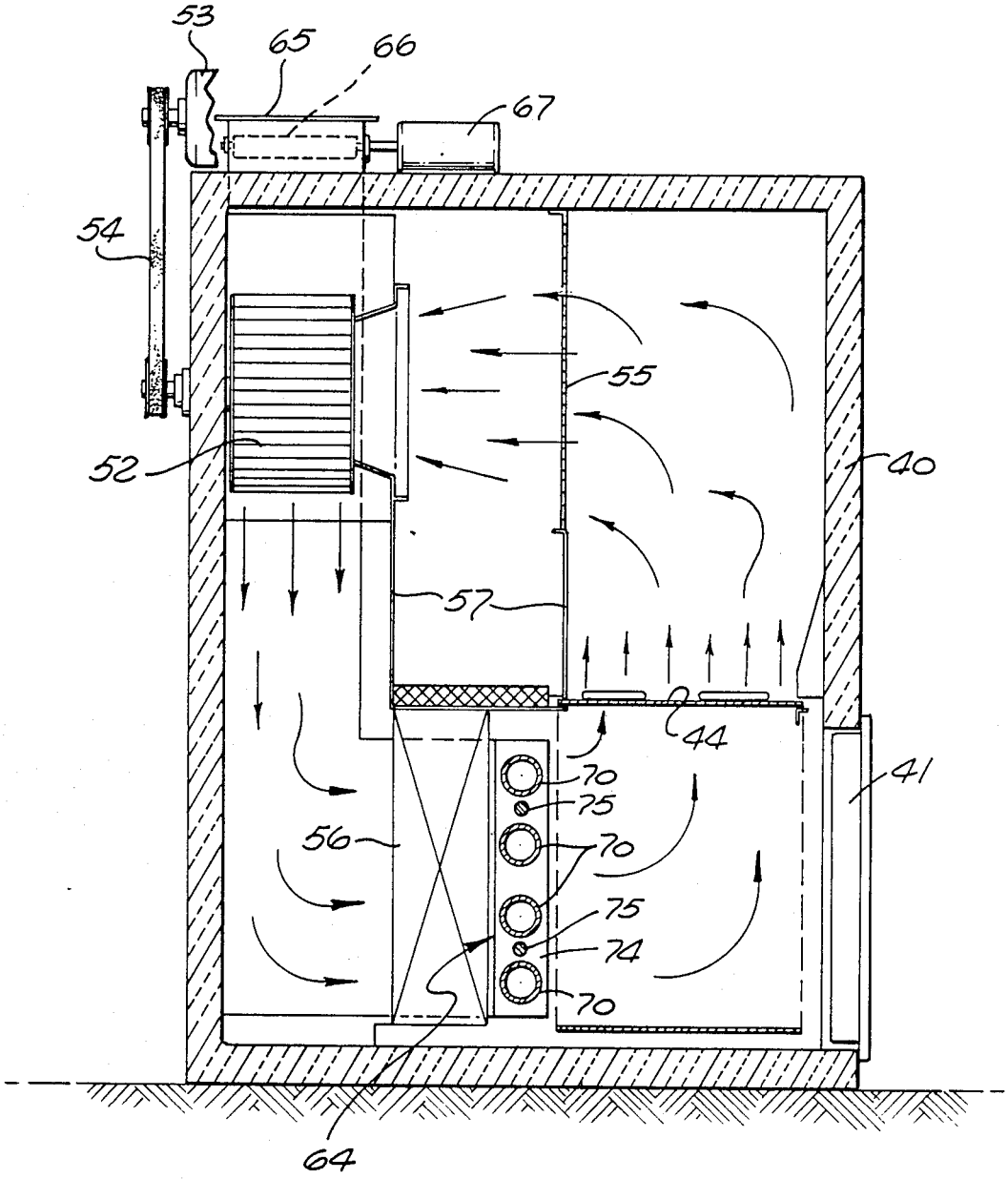
FIG. 3 is an end view taken in section along the line 3—3 of FIG. 1.

The freezing system as illustrated in FIGS. 1-3 includes a cryogenic freezer 11 and mechanical refrigeration freezer 12. Typically the cryogenic freezer may be that shown in U.S. Pat. No. 3,832,864 . The cryogenic freezer includes an insulated tank 13 and an insulated cover 14, with a quantity of liquid nitrogen 15 in the tank. A conveyor belt 16 driven by pulleys 17, 18, 19 provides for transporting product from an inlet 20 to an outlet 21 of the freezer.

Flow of liquid nitrogen into the tank is controlled by a solenoid operated feed valve 22 controlled by an automatic liquid level control system, and a drain pipe provides for draining the tank when desired. Product may be delivered to the freezer by a conveyor belt 24 and dropped through an access opening 25. Alternatively product may be delivered by a conveyor belt 26 and transferred directly onto the belt 16. Typically, loose items such as strawberries for individual freezing would be delivered on the belt 24, while larger items such as meat patties would be delivered on the belt 26. A variable speed drive motor for the belt 16 is carried in the motor compartment 28, with a drive chain 29 connecting the motor outlet to the pulleys 17, 18, and 19.

A vapor collection chamber 32 is provided between the cryogenic freezer 11 and the mechanical refrigeration freezer 12 and preferably is provided with upper and lower access doors 33, 34, respectively. Desirably, a vapor shield and collector shroud 35 is provided over the opening 25, and a hinged door 36 is provided at the belt 26. A control panel 37 for the cryogenic freezer is mounted on the side, as seen in FIG. 1.

The mechanical refrigeration freezer includes an insulated housing 40 with one or more access doors 41, and an inlet 42 and an outlet 43. A conveyor belt 44 is carried on a plurality of sprockets 45 and is driven by another variable speed motor in housing 46. Air flow curtains 47, 48 are provided at the inlet and outlet, respectively, for reducing leakage at the inlet and outlet.

Two systems 50, 51 for recirculating cooling air in the housing 40 are shown in the drawings, with one system adjacent the inlet and the other system adjacent the outlet. These systems are identical and only one will be described in detail. Additional systems can be used for larger capacity freezers.

The system 50 includes a blower 52 driven by an externally mounted motor 53 and belt 54, an externally located refrigeration compressor (not shown) and a refrigeration evaporator coil 56. Suitable baffles 57 are provided within the housing 40 to define an air flow path around the loop of the blower 52, the evaporator coil 56, and the conveyor belt 44. A perforated metal screen or plate 55 in the air flow path protects the blower 52 from product which might be carried in the air stream. A set of adjustable baffles 58 may be positioned in this air flow path for additional flow control. A control panel 59 for the mechanical refrigeration system is mounted on the exterior of the housing. The product is delivered to the belt 44 from the belt 16 at the inlet, and is deposited from the belt 44 onto another conveyor belt 60 at the outlet.

A vapor flow path is provided through the housing 40 for the cryogenic vapor from the cryogenic freezer. In the embodiment illustrated, the vapor flows from the collection chamber 32 through an inlet 63, a vapor-to-air heat exchanger 64 and an outlet 65. A baffle 66 is positioned in the outlet 65, with the baffle position being controlled by a motor 67 for providing a control of rate of vapor flow along the vapor flow path. In the preferred embodiment illustrated, the vapor-to-air heat exchanger includes four tubes 70 supported between an inlet manifold 71 and an outlet manifold 72, providing parallel flow paths from adjacent the housing inlet to adjacent the housing outlet. The specific tube construction and orientation is not critical.

The heat exchanger is positioned in the air flow path downstream of the evaporator coil 56 and upstream of the portion of the belt 44 carrying the product, as best seen in FIG. 3. With this arrangement, the lowest temperature in the air flow path is at the heat exchanger and therefore the moisture in the circulating air condenses and freezes on the heat exchanger rather than on the evaporator coil. Means are provided for continuously removing ice from the heat exchanger. In the specific embodiment illustrated, scraper plates 74 are positioned along the tubes 70, with the plates joined by rods 75. Each scraper plate 74 has openings for slidingly receiving the tubes 70, with the tubes being a close fit. The scraper plates are reciprocated horizontally along the tubes, as shown in FIG. 2, being driven by the motor 46 which also drives the belt 44, through a drive rod 76 and eccentric 77. The scrapers can be driven by a separate motor or an air or hydraulic cylinder. The driving system for the scrapers can be placed at the inlet end as well as at the side of the mechanical freezer.

In operation, product is delivered to the cryogenic freezer on belt 24 or belt 26, and is dropped into the liquid nitrogen 15 onto the belt 16. The product is delivered from the belt 16 onto the belt 44 of the mechanical refrigeration system. The product is further cooled as it moves through the mechanical refrigeration system and is deposited onto the belt 64 for subsequent handling. In a typical system the cryogenic freezer is about 5 to 10 feet long and the mechanical refrigeration freezer can be 8 to 80 feet long. The conveyor belts 16 and 44 can be any size, typically one to 6 feet wide. Of course, the sizes are selected depending on the particular products to be frozen and the desired capacity. Also, while a liquid nitrogen immersion freezer is shown for the cryogenic freezer, other cryogenic freezers can be used. The cryogenic vapor from the cryogenic freezer passes from the cryogenic freezer through the heat exchanger in the mechanical refrigeration freezer to the exhaust, with the rate of flow being controlled by the outlet baffle 66. The cryogenic vapor flow through the heat exchanger produces additional cooling of the air in the mechanical refrigeration freezer, with a result of improvement in freezing efficiency.

Figure 4:
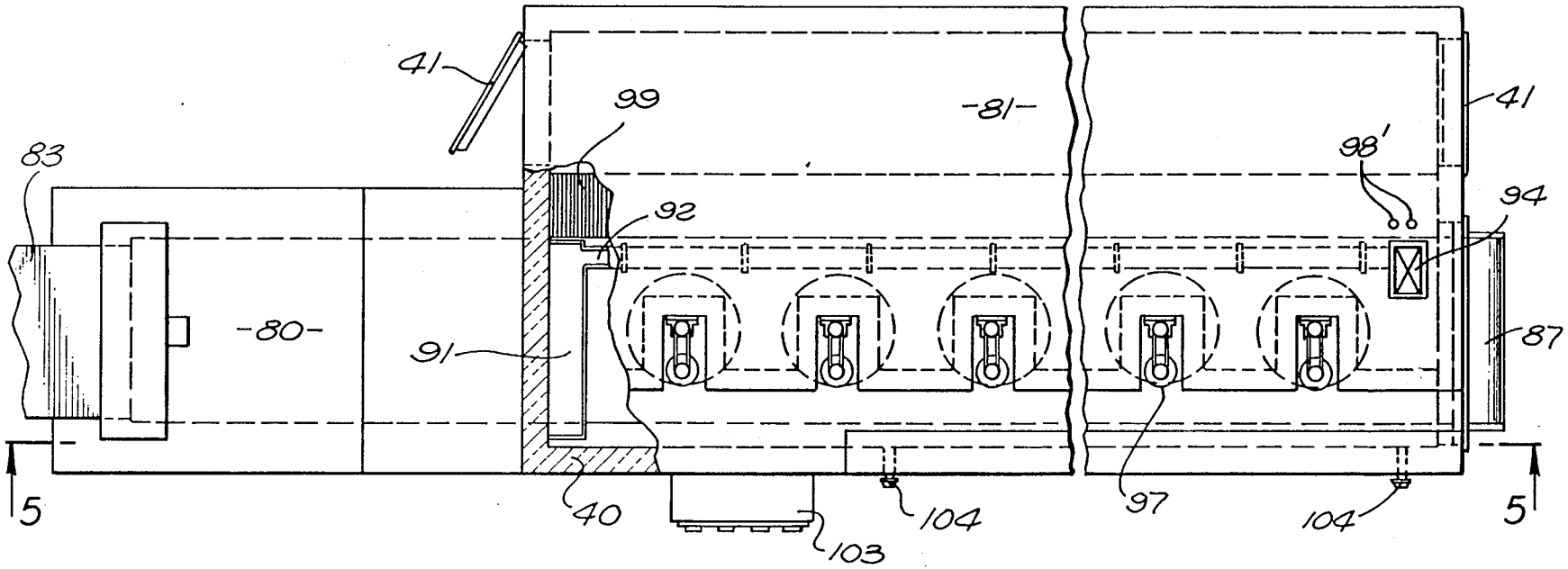
FIG. 4 is a top view of an alternative embodiment of the freezing system of the invention.
Figure 5:
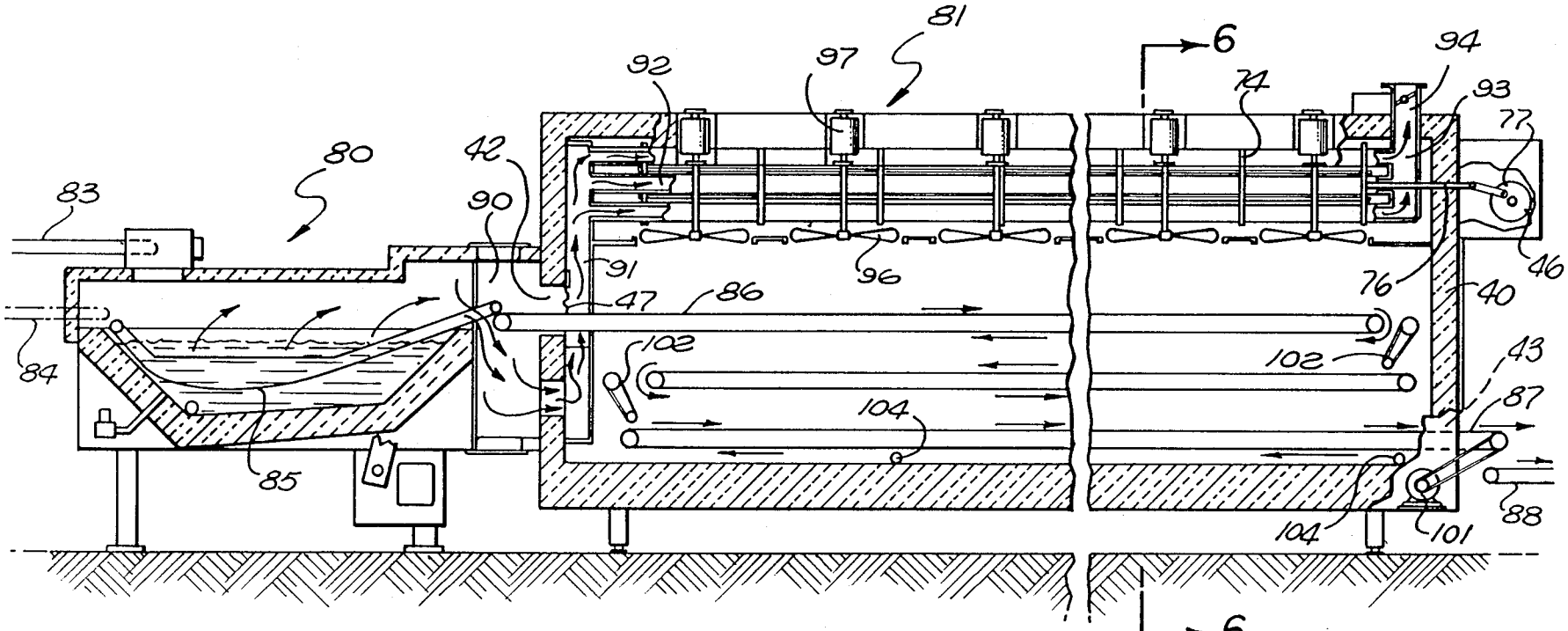
FIG. 5 is a side view of the system of FIG. 4 taken partly in section.
Figure 6:
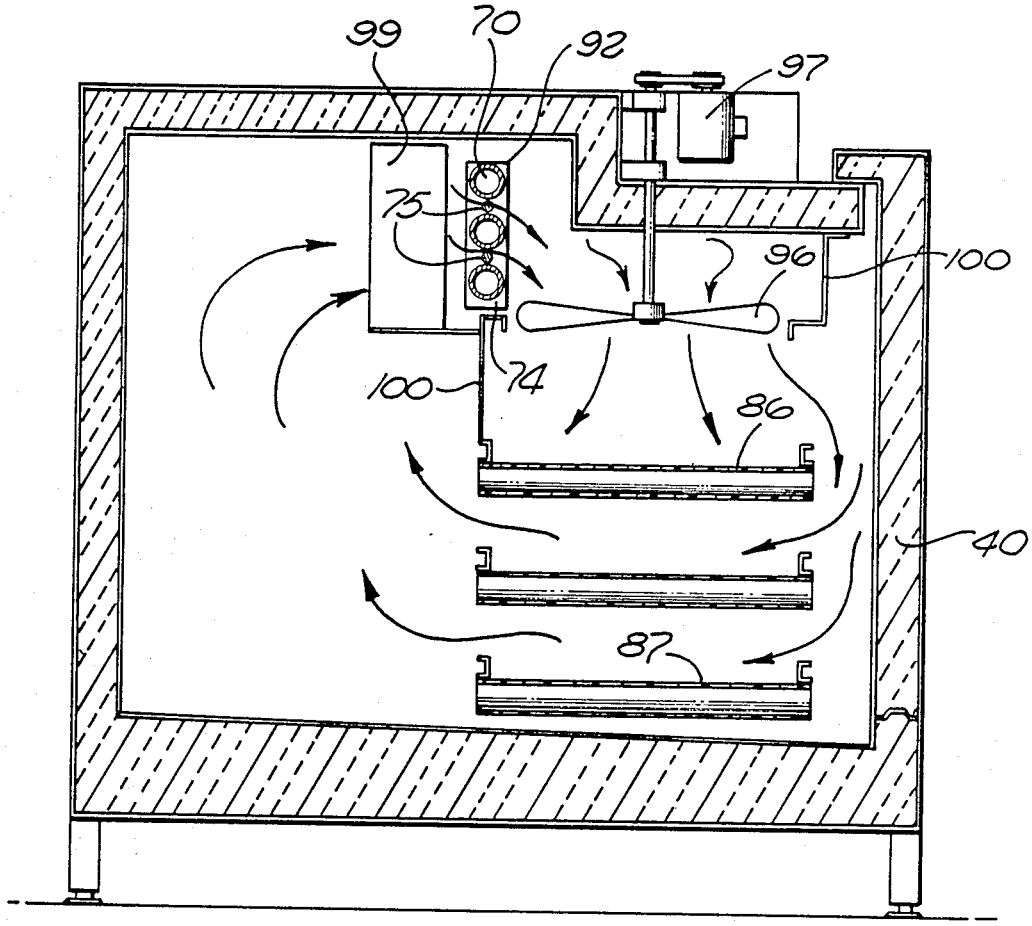
FIG. 6 is an end view taken in section along the lines 6—6 of FIG. 5.

An alternative embodiment for the freezing system is shown in FIGS. 4, 5 and 6. This system is a tiered conveyor arrangement in the mechanical refrigerator freezer. At the same time, the basic construction and operation is the same as that described for the embodiment of FIGS. 1–4, with a cryogenic freezer 80 and with a mechanical refrigerator freezer 81. Product is delivered to the cryogenic freezer 80 on a belt 83 or 84, is carried through the cryogenic freezer on another belt 85, and is transferred to the first belt 86 of the mechanical refrigerator freezer. The mechanical refrigerator freezer has three belts positioned one above the other, with the product moving from the end of one belt downward onto the next belt below which is driven in the opposite direction. The lowest belt 87 delivers the frozen product to another belt 88 for moving the product away from the freezer. Other alternative arrangements for the mechanical freezer product movement include the spiral configuration with a drive and the serpentine configuration with two drives.

The cryogenic vapor from the cryogenic freezer passes into a vapor collection chamber 90 and then into an inlet manifold 91 of a vapor-to-air heat exchanger 92, to an outlet manifold 93 and an outlet duct 94 for the vapor. The construction and operation of the heat exchanger 92 may be the same as for the heat exchanger 72. A vapor flow control baffle and motor may be provided at the outlet of the vapor flow path as with the embodiment of FIGS. 1–4.

The mechanical refrigeration freezer includes a plurality of fans 96 driven by motors 97, a refrigeration compressor-condenser package located outside of the freezer and connected at lines 98, a refrigeration evaporator coil 99, and suitable baffles 100 for defining an air flow path within the insulated housing 40 around the fans, conveyor belts, evaporator coil and heat exchanger. As with the embodiment of FIGS. 1–4, the heat exchanger is positioned between the evaporator coil and the food product on the conveyor belts.

A scraper system comprising plates 74, rods 75, drive motor 46, drive rod 76 and eccentric 77 may be used as in the embodiment of FIGS. 1–3. One or more of the belts may be driven by a drive motor 101, and transfer conveyors 102 provide for product transfer from belt to belt. The freezer also includes a control panel 103 and drain lines 104.

I claim:

1. In a freezing system, the combination of:

a cryogenic freezer having a first product inlet and a first product outlet, first conveyor belt means for moving product from said first product inlet to said first product outlet, a source of cryogenic material, and a first cryogenic vapor outlet; and a mechanical refrigeration freezer having a second product inlet and a second product outlet, second conveyor belt means for moving product from said second product inlet to said second product outlet, a refrigeration evaporator coil, a blower, a first cryogenic vapor inlet and a second cryogenic outlet, first flow means defining a cryogenic vapor path from said first cryogenic vapor outlet through said first cryogenic vapor inlet to said second cryogenic vapor outlet, and second flow means defining an air flow path from said blower through said refrigeration evaporator coil, said first flow means and said second belt means.

2. A freezing system as defined in claim 1 wherein said first flow means includes a vapor-to-air heat exchanger positioned in said air flow path for air flow from said evaporator coil past said heat exchanger to said second belt means.

3. A freezing system as defined in claim 2 wherein said heat exchanger includes means defining a vapor flow path there through separate from said air flow path.

4. A freezing system as defined in claim 2 wherein said heat exchanger includes passage means providing a vapor flow path from adjacent said second product inlet to adjacent said second product outlet.

5. A freezing system as defined in claim 4 including means for removing frost from said passage means while said freezing system is in operation.

6. A freezing system as defined in claim 2 wherein said heat exchanger includes a plurality of tubes arranged in parallel providing a plurality of vapor flow paths from adjacent said second product inlet to adjacent said second product outlet.

7. A freezing system as defined in claim 6 including means for removing frost from said tubes while said freezing system is in operation and comprising scraper means positioned on said tubes for sliding along said tubes, and drive means for reciprocating said scraper means along said tubes.

8. A freezing system as defined in claim 2 wherein said second flow means provides a recirculating air flow path with said blower downstream of said second belt means and upstream of said evaporator coil.

9. A freezing system as defined in claim 2 wherein said second flow means provides a recirculating air flow path with said blower downstream of said heat exchanger and upstream of said second belt means.

10. A freezing system as defined in claim 2 wherein said first flow means further includes:

means defining a vapor collection zone between said first cryogenic vapor outlet and said first cryogenic vapor inlet;

exhaust duct means for conducting cryogenic vapor from said heat exchanger to said second cryogenic vapor outlet; and means for controlling the rate of flow of cryogenic vapor through said exhaust duct means.

11. A freezing system as defined in claim 1 including a first variable speed drive means for said first belt means and second variable speed drive means for said second belt means.

12. A freezing system as defined in claim 1 wherein said cryogenic freezer is a liquid immersion freezer.

* * * * *